US008269085B1

(12) United States Patent
Darbon

(10) Patent No.: US 8,269,085 B1
(45) Date of Patent: Sep. 18, 2012

(54) BACKLESS MOBILE GUITAR STRAP

(76) Inventor: Paul C. Darbon, Rancho Mirage, CA (US)

( * ) Notice: Subject to any disclaimer, the term of this patent is extended or adjusted under 35 U.S.C. 154(b) by 32 days.

(21) Appl. No.: 13/027,164

(22) Filed: Feb. 14, 2011

Related U.S. Application Data

(63) Continuation-in-part of application No. 12/455,511, filed on Jun. 2, 2009, now Pat. No. 7,888,573.

(60) Provisional application No. 61/057,975, filed on Jun. 2, 2008.

(51) Int. Cl.
*G10D 3/00* (2006.01)

(52) U.S. Cl. ..... 84/327; 224/265; 224/266

(58) Field of Classification Search ..... 84/327; 224/265, 266
See application file for complete search history.

(56) References Cited

U.S. PATENT DOCUMENTS

| | | | | | |
|---|---|---|---|---|---|
| 2,061,464 | A | * | 11/1936 | Heimers | 84/280 |
| 2,712,779 | A | * | 7/1955 | Tolcher | 294/139 |
| 4,192,213 | A | * | 3/1980 | Steinberger | 84/293 |
| 4,387,839 | A | * | 6/1983 | Dranchak | 224/265 |
| 4,450,993 | A | * | 5/1984 | Ephraim | 224/265 |
| RE31,722 | E | * | 11/1984 | Steinberger | 84/327 |
| 4,799,610 | A | * | 1/1989 | Hsieh | 224/266 |
| D302,171 | S | * | 7/1989 | Assel et al. | D16/243 |
| D308,782 | S | * | 6/1990 | Getsi | D6/567 |
| 4,963,904 | A | * | 10/1990 | Lee | 396/423 |
| 5,074,222 | A | * | 12/1991 | Welch | 108/43 |
| D324,874 | S | * | 3/1992 | Kardach | D16/243 |
| D329,349 | S | * | 9/1992 | Moreno | D6/567 |
| D350,556 | S | * | 9/1994 | Costanza | D16/243 |
| 5,372,346 | A | * | 12/1994 | Upchurch et al. | 248/304 |
| 5,560,497 | A | * | 10/1996 | Mulvihill, Jr. | 211/4 |
| 5,612,756 | A | * | 3/1997 | Kardach | 396/422 |
| 6,040,509 | A | * | 3/2000 | Fanella | 84/280 |
| 6,641,010 | B2 | * | 11/2003 | Greene | 224/265 |
| 6,796,468 | B1 | * | 9/2004 | Nideborn et al. | 224/266 |
| 7,485,785 | B1 | * | 2/2009 | Steinberger | 84/327 |
| 7,591,401 | B2 | * | 9/2009 | Sandler | 224/201 |
| 7,888,573 | B1 | * | 2/2011 | Darbon | 84/327 |
| 8,053,655 | B2 | * | 11/2011 | May | 84/421 |

* cited by examiner

*Primary Examiner* — David Warren
*Assistant Examiner* — Robert W Horn
(74) *Attorney, Agent, or Firm* — Grant's Law Firm; Allan Grant

(57) ABSTRACT

An instrument shoulder strap device and method for use with musical instruments, wherein the device comprises: a backless shoulder strap; the shoulder strap has an adjustable front strap; an U shaped mounting bracket, which is attached to the shoulder strap; the U shaped mounting bracket has slidable connecting means for connecting an instrument to the shoulder strap; and wherein the instrument has a pivot axle member having attachment means for attaching the member to the instrument, thereby allowing a user the ability to connect the pivot axle member to the U shaped mounting bracket for attaching and detaching the instrument to the shoulder strap.

19 Claims, 10 Drawing Sheets

BACKLESS MOBILE GUITAR STRAP

CROSS-REFERENCE TO RELATED APPLICATIONS

This is a continuation in part patent application which claims priority under 35 U.S.C. 120 and under applicable U.S. statutes and regulations, to U.S. patent application Ser. No. 12/455,511, filed Jun. 2, 2009, now U.S. Pat. No. 7,888,573, which claimed priority under 35 U.S.C. 119(e) and under all applicable U.S. statutes and regulations, to U.S. Provisional Application Ser. No. 61/057,975, filed Jun. 2, 2008. The disclosure of which is hereby incorporated herein by reference in its entirety.

FIELD OF THE INVENTION

The present invention relates to method and structure for supporting an instrument, more particularly for a method and structure providing an attachment means for connecting the guitars or guitar video game controls to a stand, a strap, a belt, or a wall mount depending on the user's desired needs.

The present invention further relates to straps used by musicians, more particularly to provide a strap for supporting a musical instrument such as a guitar or guitar video game control, whether the instrument is in use or at rest.

BACKGROUND OF THE INVENTION

This invention allows performer who utilizes guitars as their musical instrument to easily and frequently change to a different type of guitars while performing. Some of the different types of guitars are the classic, flamenco, plectrum, acoustic, 12-string, Hawaiian, and electric. Additionally, this invention would also work with an electric bass, which has a similar guitar design.

Musical instruments such as guitars are commonly rested on special stands when not in use. These stands hold and support the instrument in a stable position and prevent the musician to lay the instrument on the floor and to stoop over to pick it up.

It is quite common that a given performer may play an electric guitar through most of his or her performance and then, during a certain time within the performance, may switch to an acoustic guitar. The electric guitar is normally supported on the performer by means of a supporting strap. Normally, the performer would have nearby an acoustic guitar which may be supported in an upright position with a stand that is located on the stage near the performer. A typical procedure for the performer to switch from the electric to the acoustic guitar would require the performer to move the electric guitar to an out-of-the way position, such as against the back of the performer, and then pick up the acoustic guitar and play such.

The switching from the one guitar to another frequently must occur quite rapidly because the switching is to occur during the playing of a song. This means that the performer may only have one-half second or less in which to switch from one instrument to another. For the performer to move the electric guitar to an out-of-the-way position, then pick up the acoustic guitar and place it in the proper position, and then proceed to play the acoustic guitar, may take longer than the required time period. This means that an error would result in the performing of the song which can normally be readily perceived by the audience.

It would therefore be desirable to locate the acoustic guitar in a ready-to-play position not requiring any picking up and positioning of the acoustic guitar. The performer only needs to move the electric guitar in an out-of-the-way position and set up the acoustic guitar and begin to play this guitar.

Unfortunately, most stands are rigid, and do not allow for use during performance with the instrument. Furthermore, most stands are not resilient or flexible, to provide resistance in playing and ease of movement. As such, there is a need in the art for a new and improved multi-purpose guitar mounting system which permits the instrument user to support the entire weight of the instrument on a stand while at the same time allowing maximum movement of the instrument.

Both acoustic and electrical guitars are typically supported by a strap that passes over the shoulder and/or around the back of the neck of the instrument user. This support arrangement places a fair amount of weight and stress on the upper shoulder and neck area as well as pressure on the back itself. Since many musicians prefer to rehearse standing, and are often expected to perform standing as well, the shoulder and neck support leads to fatigue in the muscle areas even for those in good health especially for long durations of rehearsal and/or performance. Furthermore, many modern electric guitars and especially electric basses are quite heavy, so that supporting an instrument during extended periods of play is fatiguing to a musician, which in turn impairs the musician's ability to play well. As such, there is a need in the art for a new and improved multi-purpose guitar mounting system which permits the instrument user to support the entire weight of the instrument on a strap while at the same time allowing maximum movement of the instrument.

Unfortunately, all of the prior art shares at least one common disadvantage. Little thought has been given to providing the performer with the ability to carry on the wild gyrations of the stringed instruments, as is expected and common during personal performances, and to allow the stringed instrument to be re-set or re-supported in the playing position, at the front of the performer's body, following cessation of these gyrations. Such an ability would allow the performer to continue playing the music without the stress and strain of continually supporting the instrument, or from interrupting their performance to reattach the guitar or other instrument to the support structure.

A musician may prefer to play both while sitting and standing with performance gyrations, and the musician may be required to alternate between siting and standing in a single performance, and may want to continue playing while transitioning between sitting and/or standing. However, many existing support systems either function poorly in one or another of the playing positions, or are difficult to change especially while both hands are busy playing the instrument. As such, there is a need in the art for a new and improved multi-purpose guitar mounting system that allows a user to easily transition between various guitar support systems such as a stand, a strap, or a belt as well as various sitting or standing positions while both hands are busy playing the instrument.

Guitar handling technology has been in the dark ages for too long. There are very few options for user who seek support and freedom of express from straps, rigid floor stands and wall hangers, which are difficult to use.

Since various video game console manufactures have developed a guitar video game, where a user uses a video game controller that is designed to resemble a guitar. The user/player presses buttons or plucks strings on the guitar controller in time with musical notes that scroll on the game screen. As such, there also exists a need for a new and improved multi-purpose guitar mounting system that can work with the guitar video game controller as well as real guitars.

SUMMARY OF THE INVENTION

Accordingly, an object of the present invention is to provide method and apparatus to support a guitar or other similar instruments while overcoming defects of the prior art.

In particular, it is an object of the present invention is to provide a method and apparatus to overcome the problems of stress on the neck, shoulder, and back of a user of the guitar or other similar instruments.

It is also an object of the present invention is to provide a multi-purpose holding apparatus which is relatively inexpensive, familiar to musicians, quick to learn or remove, and does not interfere with a performer's performance.

Further it is an object of the present invention is to provide a guitar stand that is easy to adjust the height and angle of the guitar or other similar instrument.

Furthermore it is an object of the present invention is to provide a guitar strap that is easy to adjust the height and position of the guitar or other similar instrument.

Even further, performances on stage should not be hindered by the multi-purpose guitar mounting system. The supporting devices should easily be detached and reattached to another supporting device or another guitar. The supporting devices such as the stand and strap should allow for use/playing of the guitar while standing, sitting, walking, gyrating, and while transitioning between these modes of play.

An object and advantage of the present invention is to provide a multi-purpose guitar mounting system to accommodate varying shapes of instrument bodies, including various shaped guitar bodies. Wherein a mounting plate having a universal pivot axle is attached to the back of the guitar using the neck attachment screws. Or alternatively, the guitar is manufactured with a universal pivot axle in the back of the guitar so that the guitar can attaching to numerous holding devices.

Another object and advantage of the present invention is to provide a multi-purpose guitar mounting support for a guitar instrument while at rest that is very easy to use.

A further object and advantage of the present invention is to provide multi-purpose guitar mounting support for a musical instrument while a musician is playing the instrument.

The multi-purpose guitar support system allows the musician various options to conveniently hold and play the instrument at the same time. This relieves the musician from carrying the weight of the entire instrument.

By attaching a mounting plate to the back of the guitar or bass using the neck attachment screws. A musician has the ability to move the guitar or bass to any of the below support devices quickly and easily by lifting the guitar off one of the U-shaped Mounting Bracket and onto another. For the first time ever a guitar or bass player now has many choices in handling their instruments, without the need for a guitar strap. By attaching the U-shaped Mounting Bracket, to several associated devices I have created, I expanded the total versatility of the instrument beyond what is now the norm, which is a strap or a wall hanger. The guitar or bass can now, for the first time ever, be handled in a myriad of interesting ways such as:

1. Floor Stand:

By attaching the U Shaped Mounting Bracket to a floor stand the instrument now floats in front of the player always ready to play or display. Additionally, the floor stand can be design with a telescoping pole so it can be easily adjusted for the musician, whether the performer is standing or sitting.

2. Backless Mobile Guitar Shoulder Strap:

By attaching the U Shaped Mounting Bracket to a padded aluminum shoulder support the guitar can now be worn by the player and used to go mobile, as guitar straps facilitate. By using a miniature wireless device the artist can go wireless and experience the ultimate in mobility and swivel the instrument 360 degrees and back while still playing, thus opening the door for some unique guitar playing tricks.

3. Wall Mount:

By mounting the U Shaped Mounting Bracket to a wall on an aluminum bracket the instrument can now be placed on the wall as if floating in perfect playing position and be displayed as art.

4. Floating Belt Buckle:

By mounting the U Shaped Mounting Bracket to a customized belt buckle or waist belt the instrument can now be placed on the player's waist, taking the weight of the instrument off the back and placing it on the hips for less back pain.

5. Floating Hip Flex:

By mounting the U Shaped Mounting Bracket to a custom bracket that attaches to a belt and hangs down on the player's thigh, the instrument can now be worn in the cool way that some players prefer to wear them, down on their thigh. By making the bracket out of a strong reinforced rubber the instrument becomes more flexible to move and play.

6. Table Stand:

By mounting the U Shaped Mounting Bracket to a small table stand, instruments can be displayed for retail and promotional purposes at the point of sale, on the counter next to the cash register, for greater exposure.

7. GFlexX Floating Designer Clothing:

By attaching the U Shaped Mounting Bracket to clothing made for entertainment purposes. The guitar or bass can float directly on the clothing the player wears.

Numerous other advantages and features of the present invention will become readily apparent from the following detailed description of the invention and the embodiments thereof, from the claims and from the accompanying drawings.

BRIEF DESCRIPTION OF DRAWINGS

These as well as other features of the present invention will become apparent upon reference to the accompanying drawings wherein like numerals designate corresponding parts in the several figures, summarized as follows.

Other features and advantages of the invention will become apparent from the following detailed description, taken in conjunction with the accompanying drawings, which illustrate, by way of example, various features of embodiments of the invention.

DETAIL DESCRIPTION OF PREFERRED EMBODIMENT

The following detailed description and accompanying drawings are provided for purpose of illustrating and describing presently preferred embodiments of the present invention and are not intended to limit the scope of the invention in anyway. It will be understood that various changes in the details, materials arrangements of parts or operational conditions which have been herein described and illustrated in order to explain the nature of the invention may be made by those skilled in the art within the principles and scope of this invention.

Figure 1:
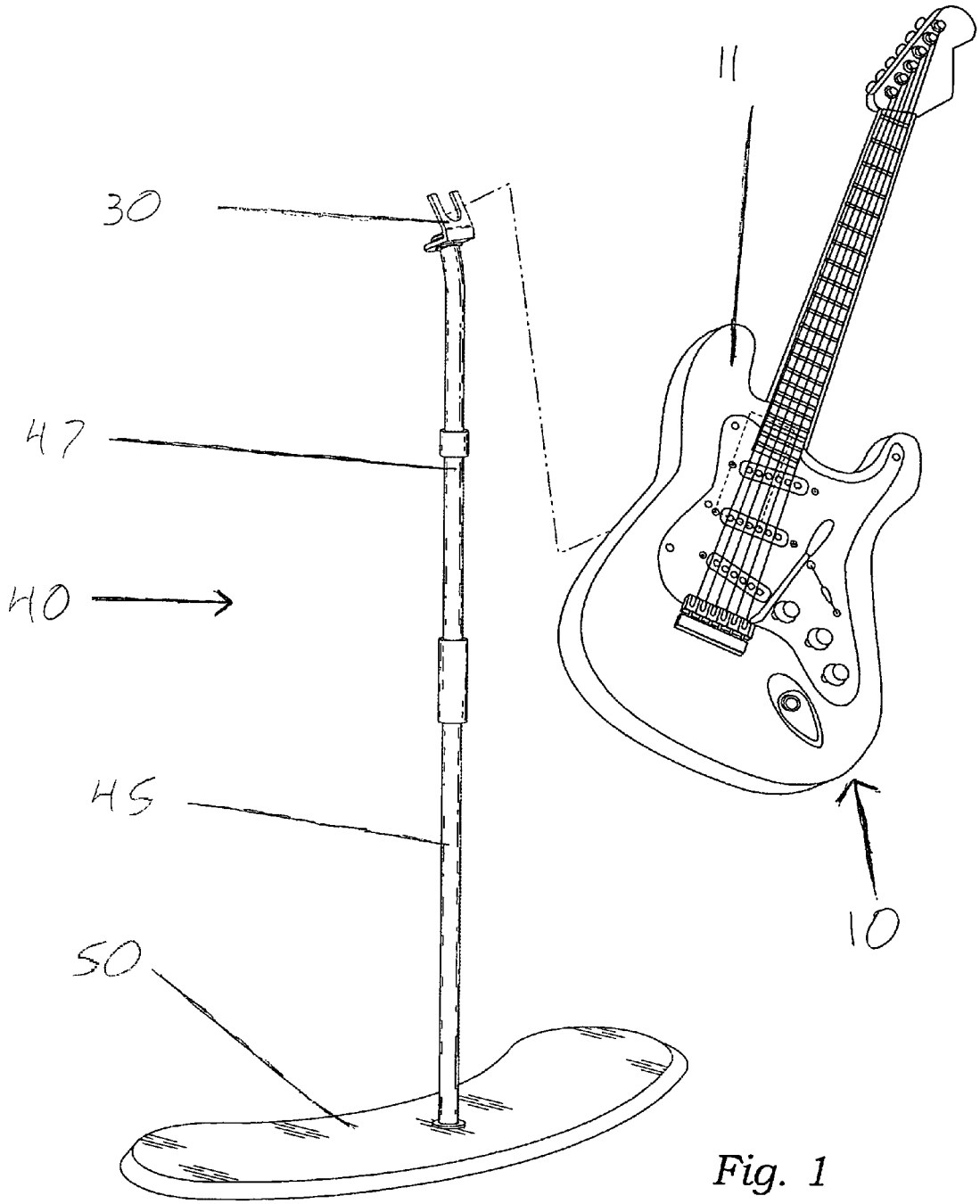
FIG. 1 is a front perspective view of an embodiment of the guitar and stand.
Figure 2:
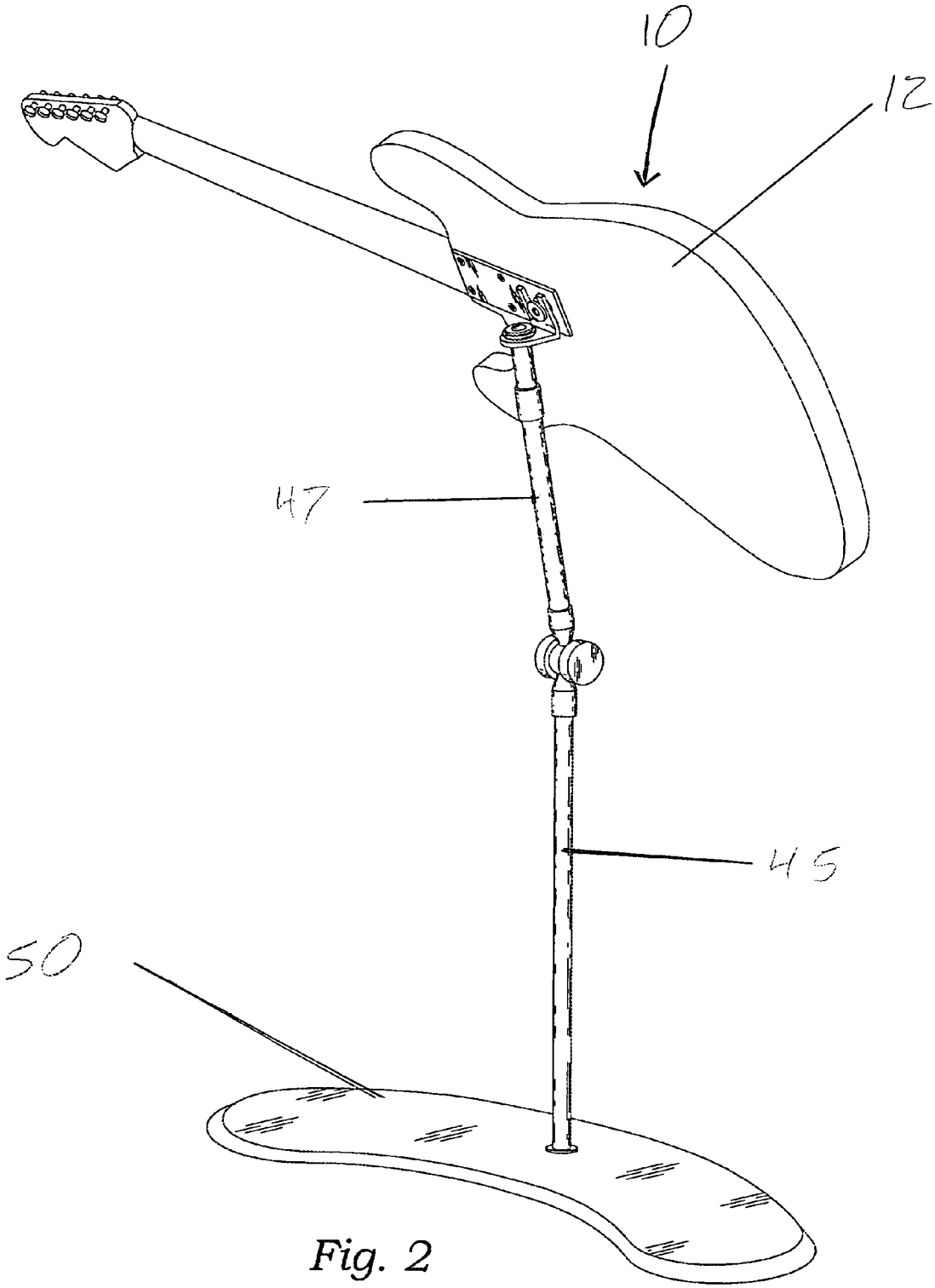
FIG. 2 is a back side perspective view of the embodiment of the guitar and an alternative embodiment of the stand.
Figure 3:
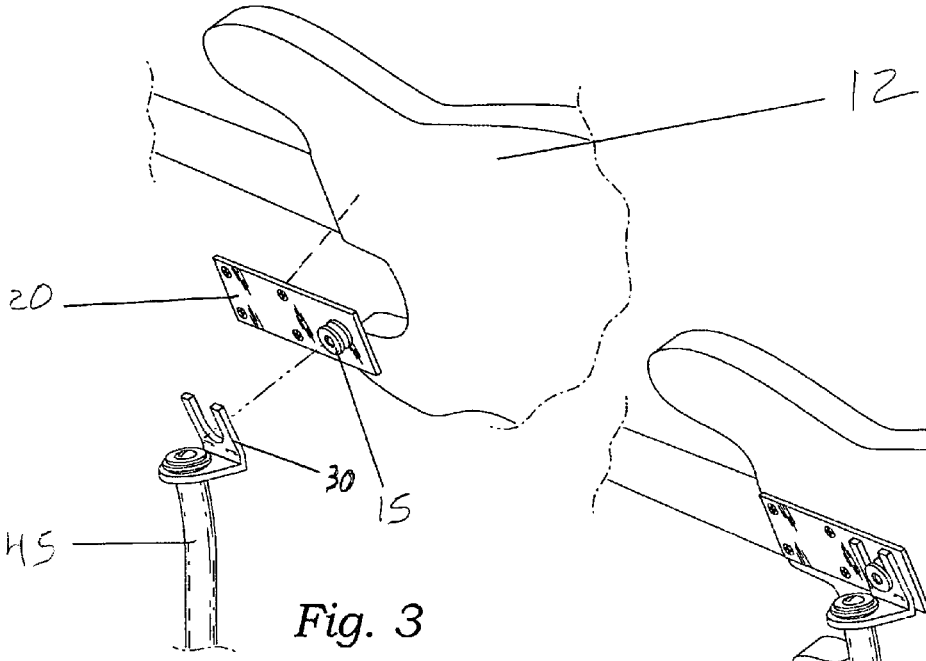
FIG. 3 is a exploded close up perspective back view of the embodiment of the stand and guitar and mounting portion.
Figure 4:
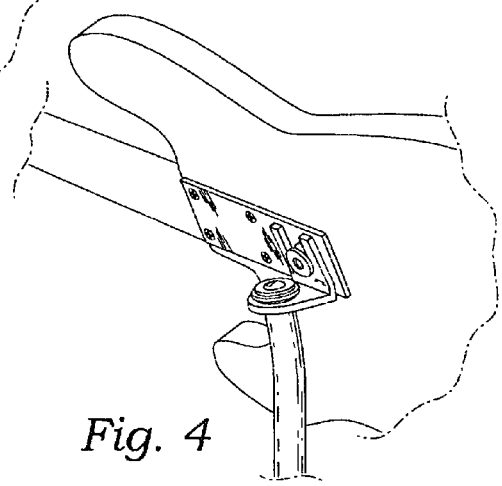
FIG. 4 is a close up perspective back view of the embodiment of the stand and guitar, wherein the guitar has a mounting portion and knob for connecting it to the mounting bracket of the stand.
Figure 5:
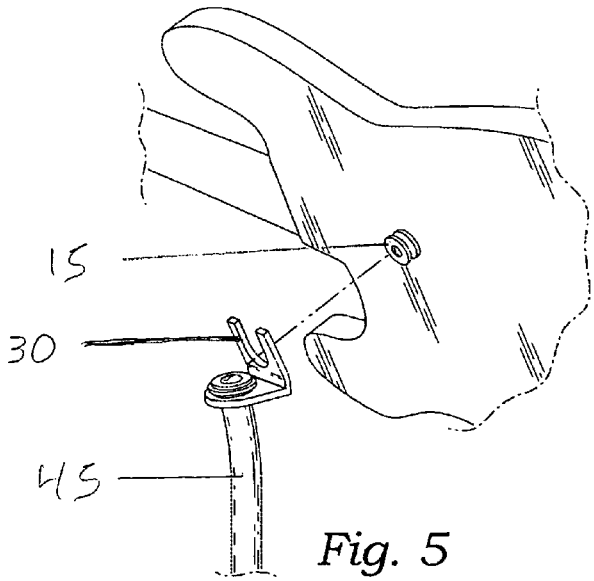
FIG. 5 is close up back side view of an embodiment of the stand and guitar with a connecting knob.
Figure 6:
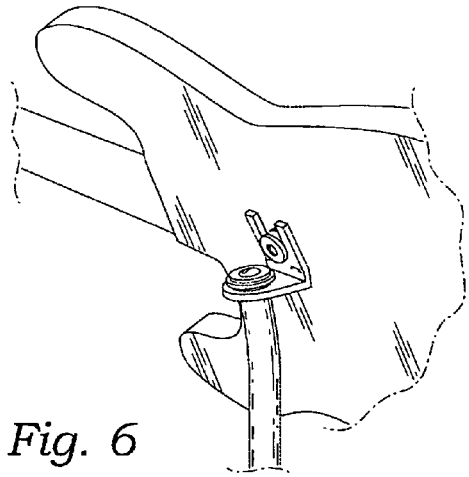
FIG. 6 is a close up back view of an alternative embodiment of the stand and guitar with a connecting knob, wherein the knob is slidable connecting it to the mounting bracket of the stand.
Figures 7, 8:
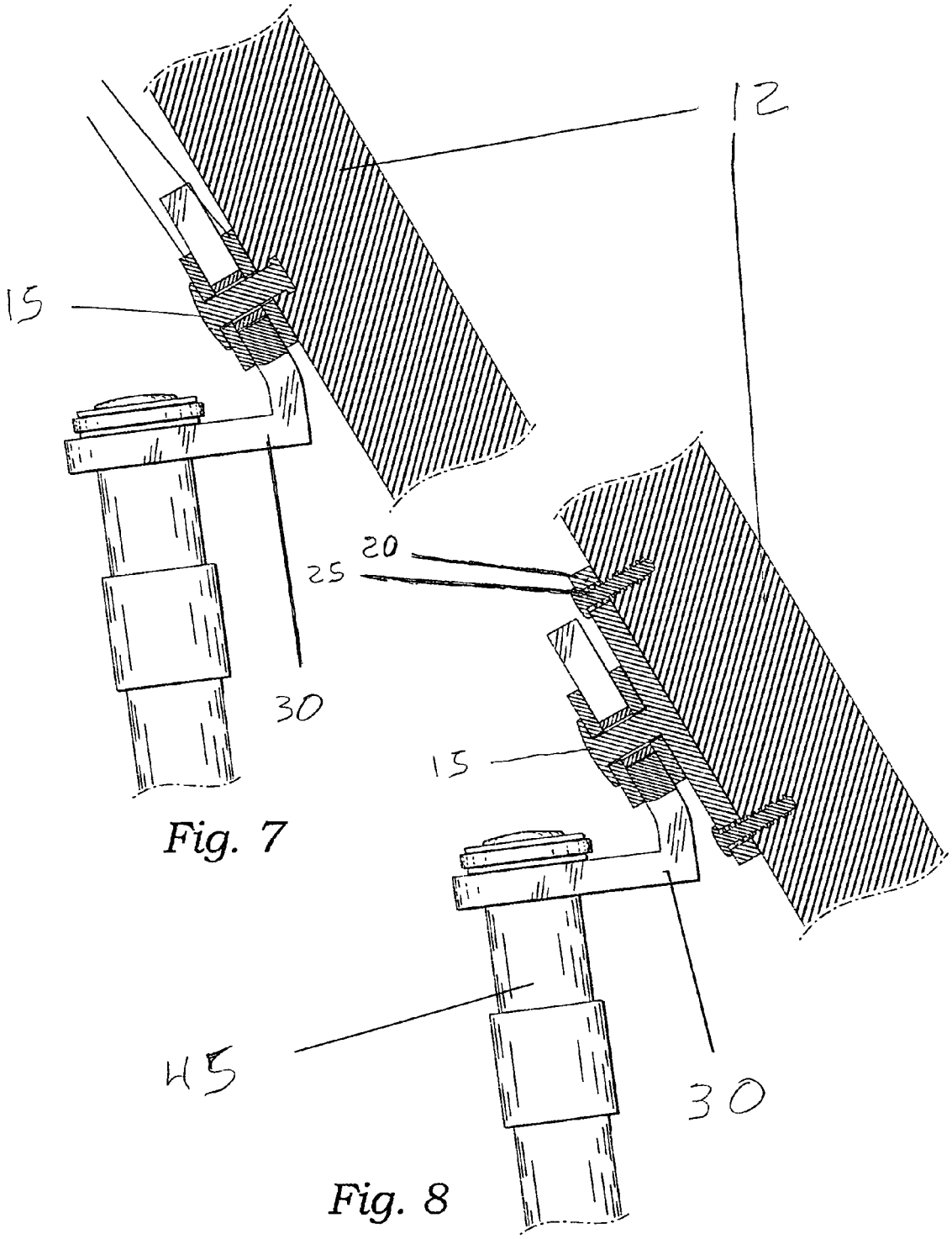
FIG. 7 is a side view an alternative embodiment of the stand and guitar with a connecting knob, wherein the knob is slidable connecting it to the mounting bracket of the stand.
FIG. 8 is a side view the embodiment of the stand and guitar, wherein the guitar has a mounting portion and knob for connecting it to the mounting bracket of the stand.
Figure 9:
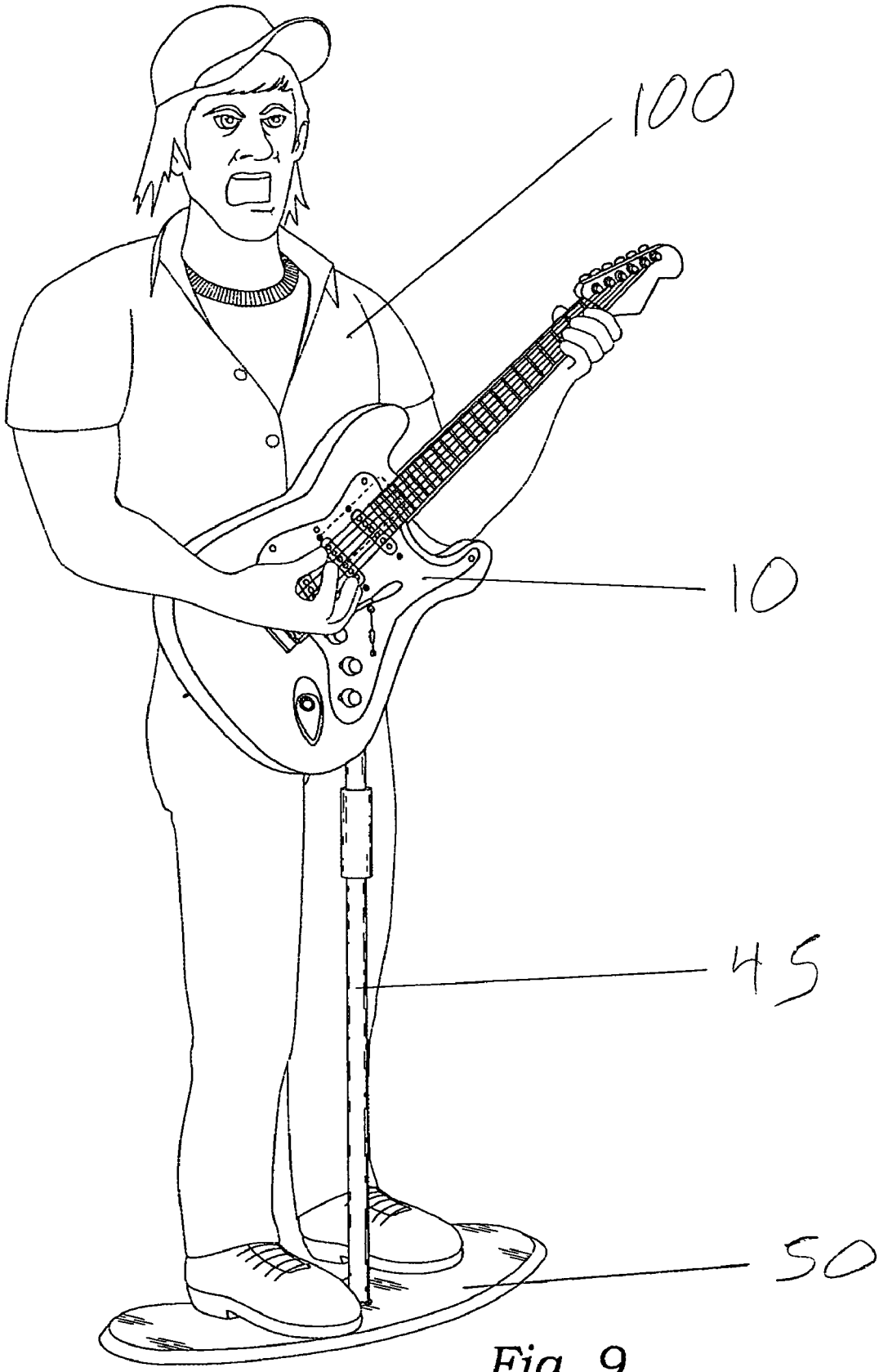
FIGS. 9 and 10 are perspective views of a user playing the guitar while it is connected to the stand.
Figure 10:
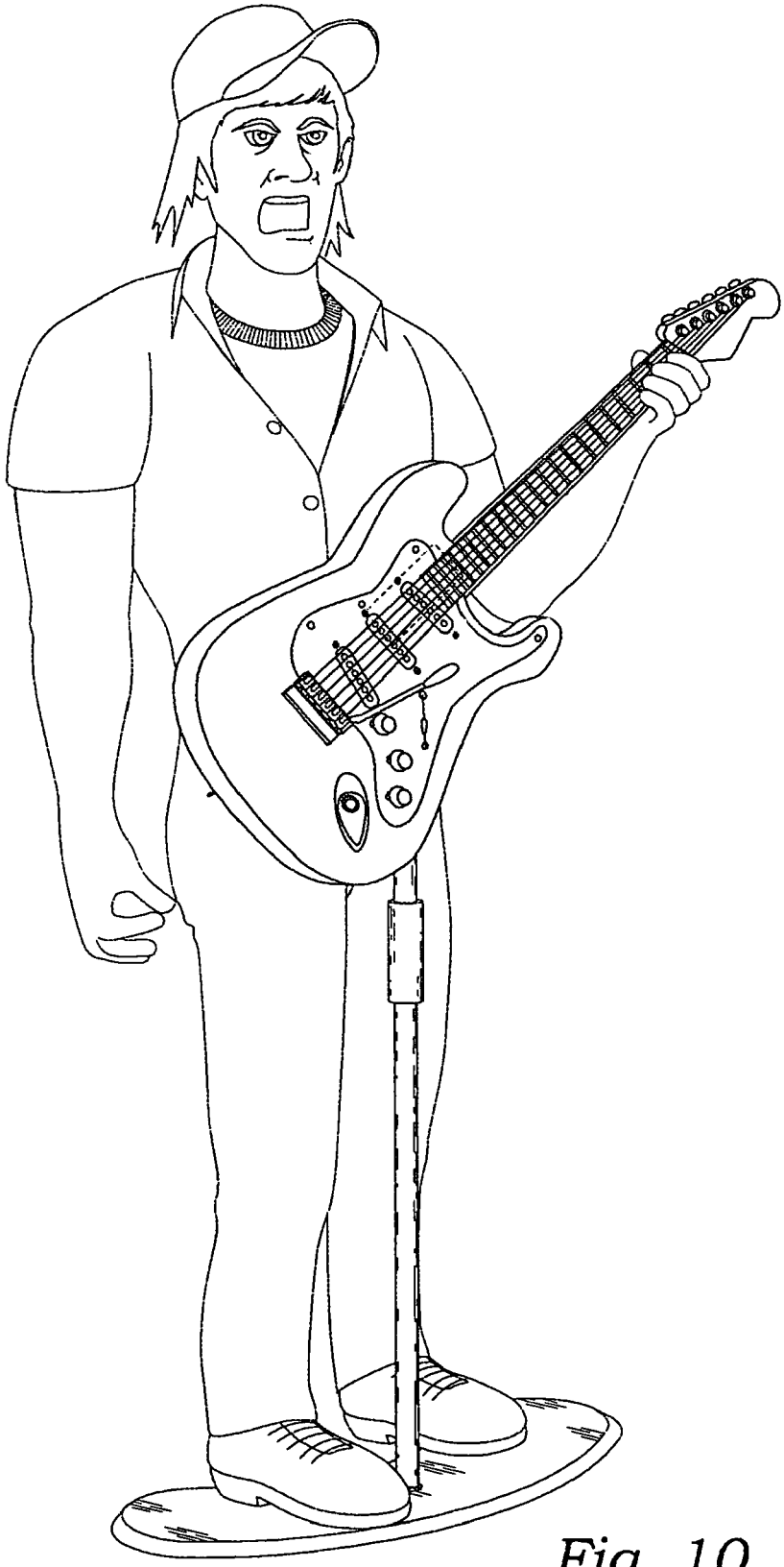
Figure 11:
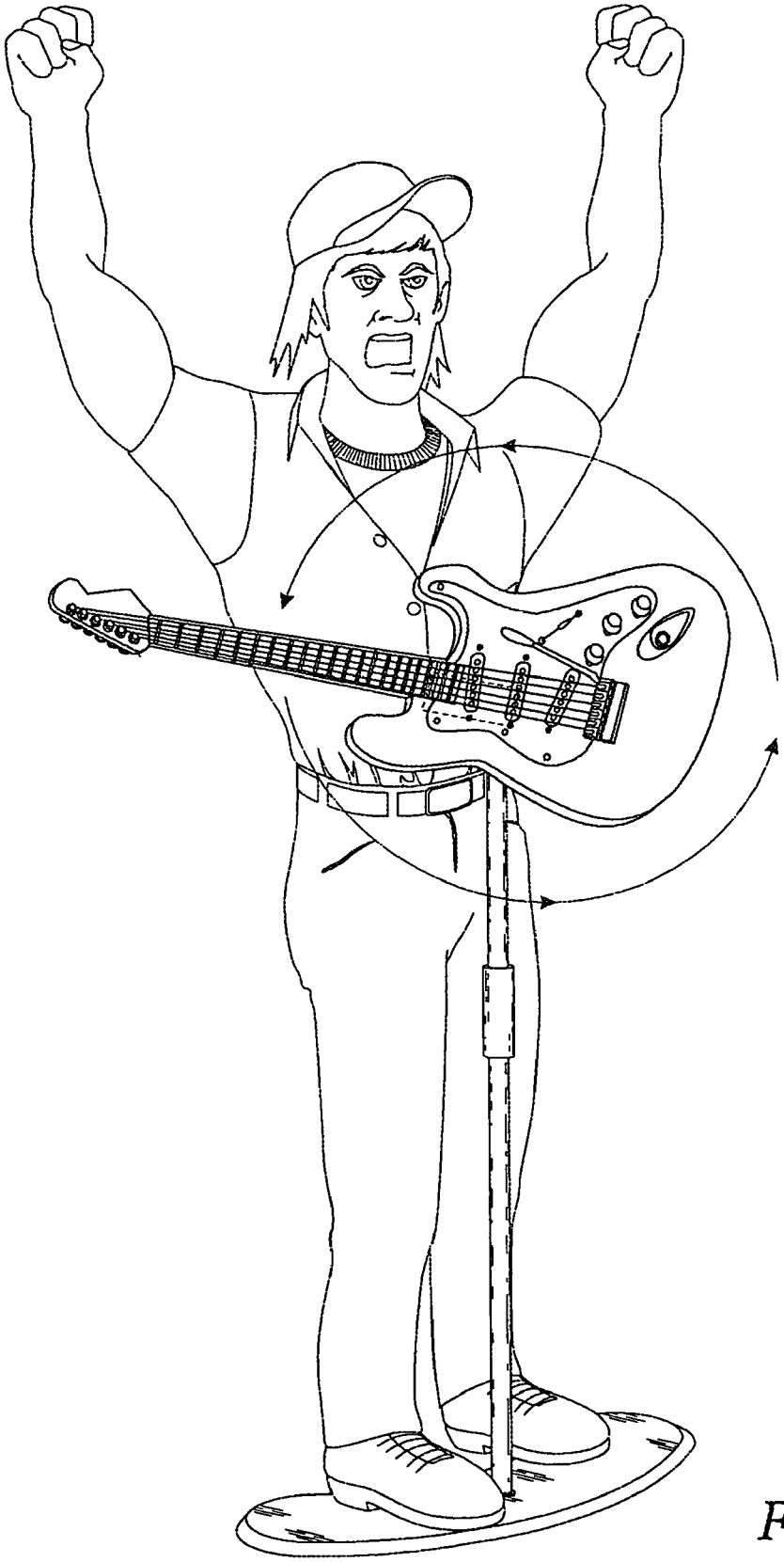
FIG. 11 is a perspective views of a user spinning the guitar while it is connected to the stand.
Figure 12:
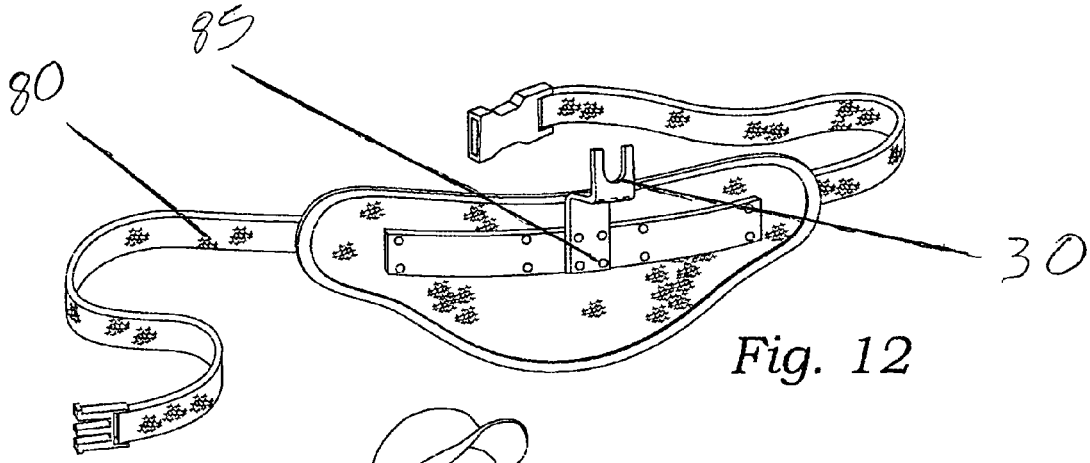
FIG. 12 is a perspective view of a belt member having a mounting bracket for attaching to the guitar knob.
Figure 13:
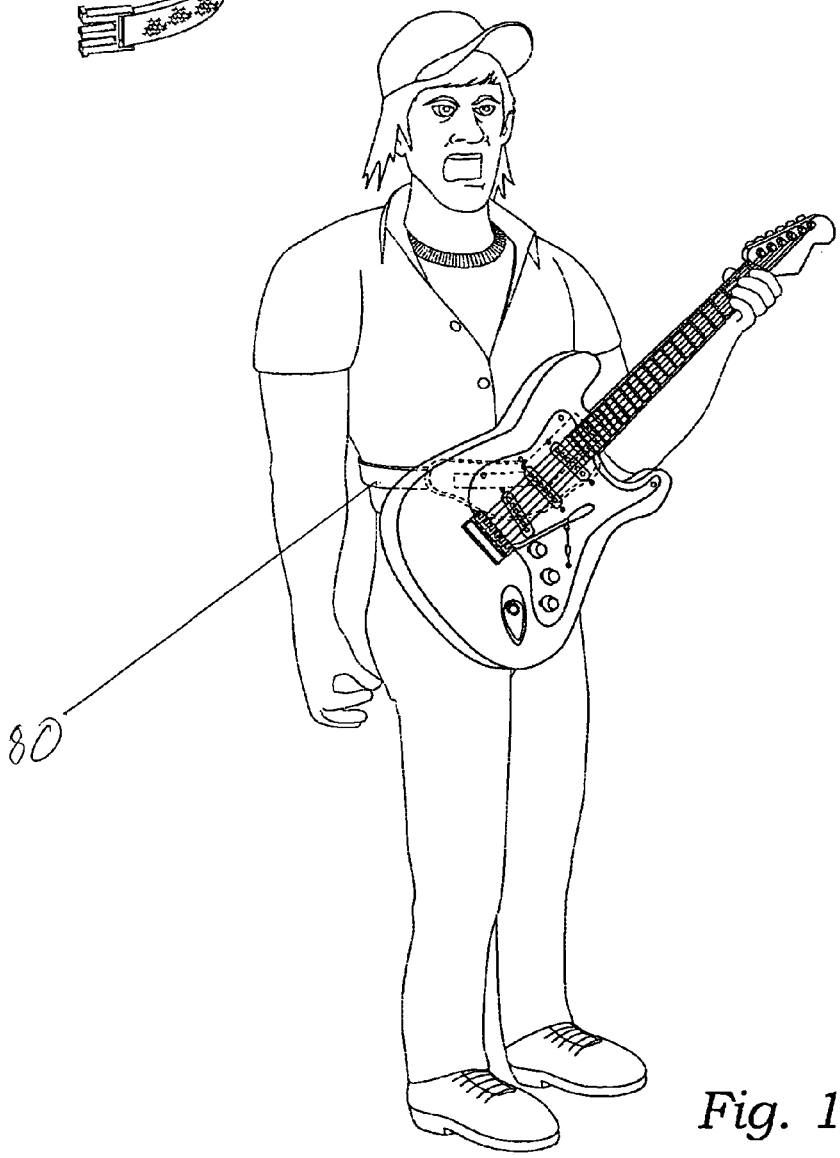
FIG. 13 is a perspective view of guitar being connected to a mounting bracket of a belt.
Figure 14:
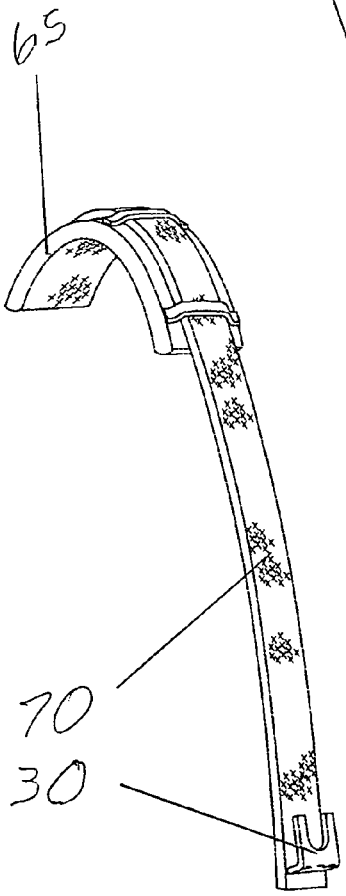
FIG. 14 is a perspective view of the preferred embodiment of an adjustable shoulder strap having a "U-mounting bracket" for attaching to the guitar knob.
Figure 15:
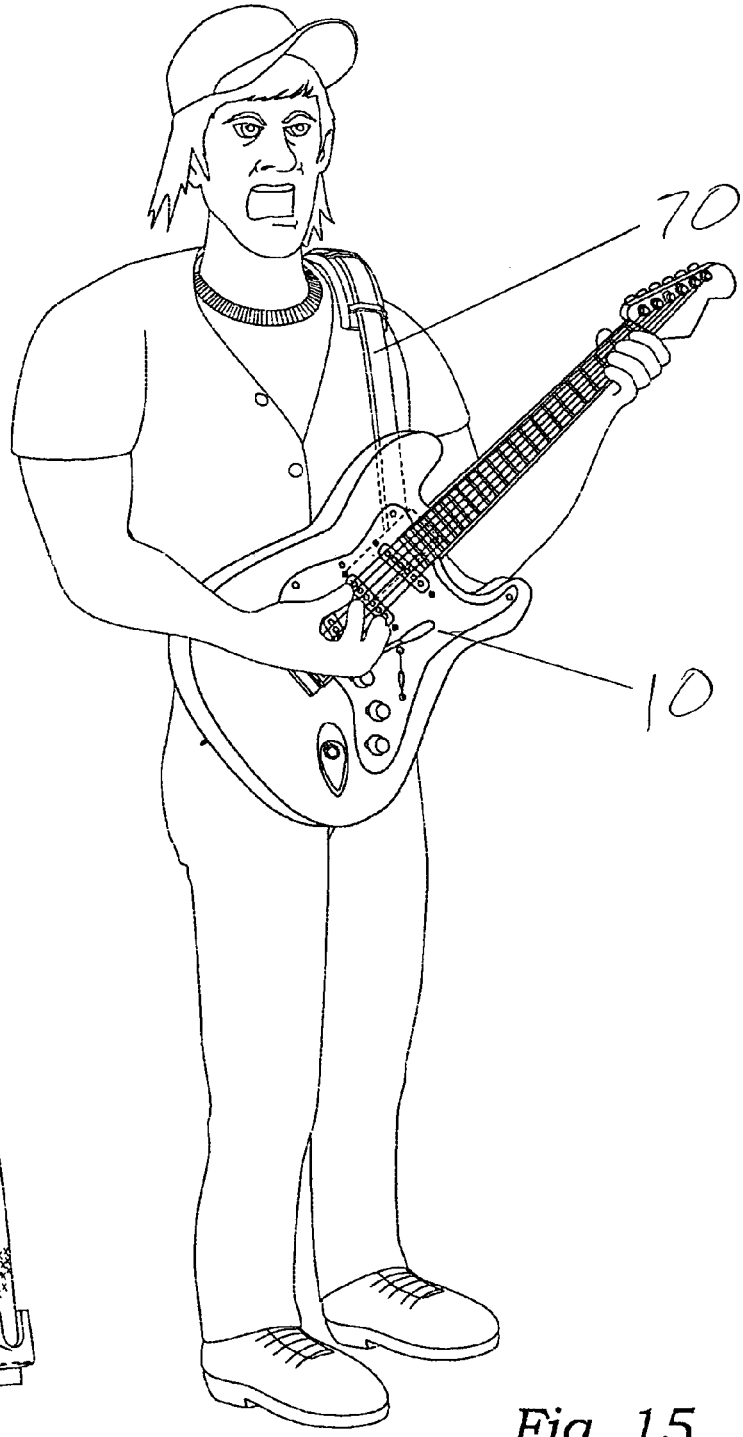
FIG. 15 is a perspective view of the preferred embodiment of a guitar being connected to an adjustable shoulder strap having a "U-mounting bracket"
Figure 16:
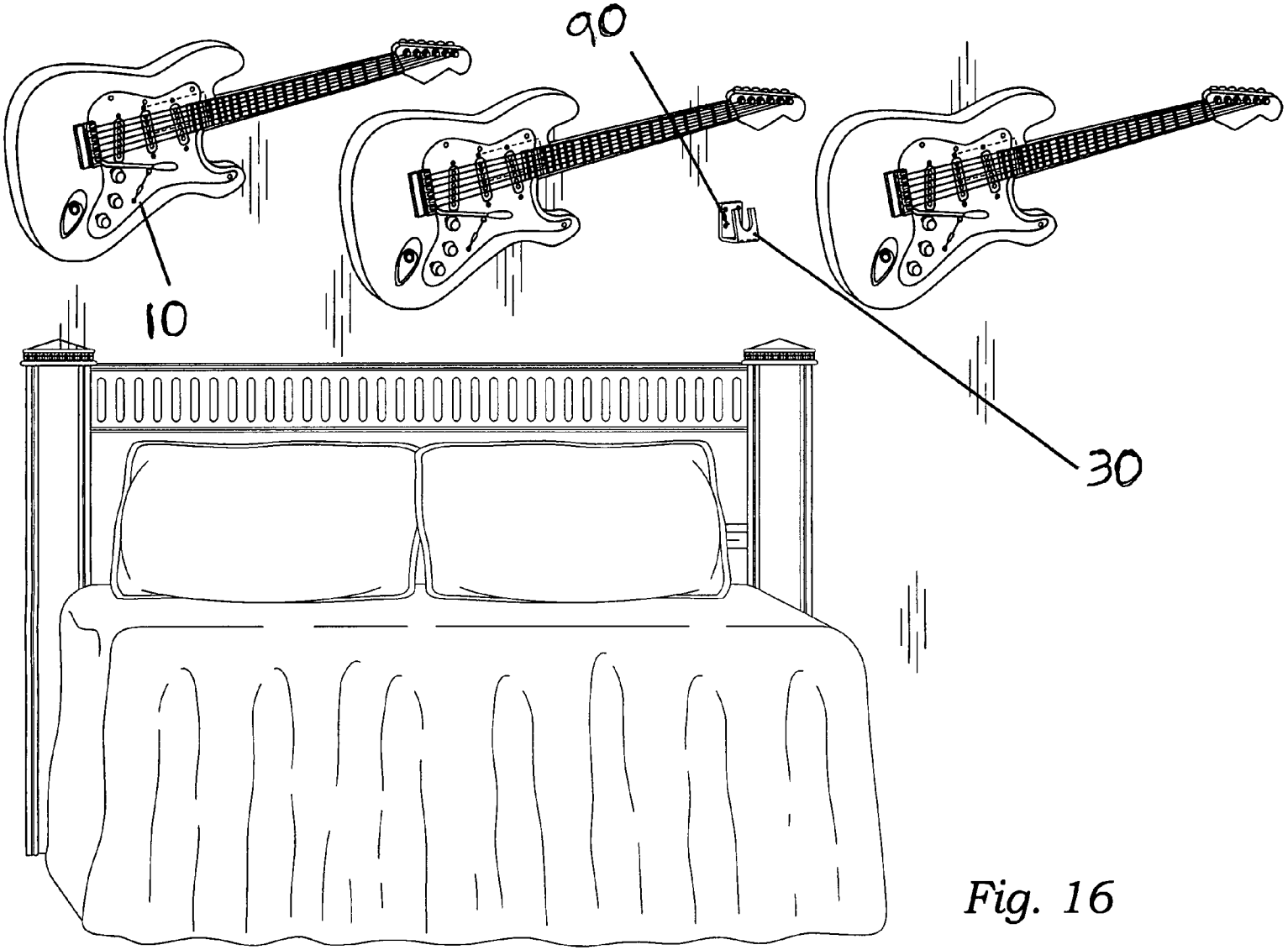
FIG. 16 is a perspective view of a wall mount having a "U shaped mounting bracket" for attaching to the guitar knob and being able to display the guitars in there natural playing position.

Referring to the drawings more particularly by reference numbers, FIGS. 1 through 16 showing the Multi-Purpose Holding System having: (1) a guitar manufactured with a pivot axle member 15 attached to the back side 12 of the guitar near the neck attachment bolts 25 of the guitar 10; (2) a guitar stand 40 comprising: a base 50, an elongated shaft 45, said U-shaped mounting bracket 30 for securing said guitar 10 to said stand 40, said base 50 has an elongated flat surface, said shaft 45 has a first end that is mounted to said base 50 and a second end that is attached to said mounting bracket 30, and wherein said U shaped mounting bracket 30 has slidable connecting means for detaching and reattaching said guitar 10 to said guitar stand 40; (3) a backless mobile guitar shoulder strap 60 comprising: a padded aluminum shoulder support 65, an adjustable front strap 70, said U shaped mounting bracket 30, said adjustable front strap 70 has said U shaped mounting bracket 30 attached to said strap 60, and wherein said U shaped mounting bracket 30 has slidable connecting means for detaching and reattaching said guitar 10 to said mobile guitar shoulder strap 60; (4) a belt 80 having a means for attaching said U shaped mounting bracket 30 to said belt 80, said belt 80 has connecting mean for attaching said belt to said user 100 and wherein said U shaped mounting bracket 30 has slidable connecting means for detaching and reattaching said guitar 10 to said belt 80; and (5) a wall mount 90 having means for attached to a wall 95 and said U shaped mounting bracket 30, wherein said U shaped mounting bracket 30 has slidable connecting means for detaching and reattaching said guitar to said wall mount 90 to provide an eye catching display.

The guitar can be selected from a group consisting of classic guitar, flamenco guitar, plectrum guitar, acoustic guitar, 12-string guitar, hawaiian guitar, electric guitar, electric bass and guitar video game controller. However, in the preferred embodiment of this invention, an electric guitar is used.

Wherein a user can select when to attach and remove said guitar from said U shaped mounting brackets and the holding mounts.

Wherein said user elects to attach said guitar to said guitar stand, said user will slidable connect said pivot axle member to said U shaped mounting bracket, thereby attaching said guitar to said guitar stand. When said user elects to slidable remove said pivot axle member from said U shaped mounting bracket, thereby detaching said guitar from said guitar stand.

Wherein said user elects to attach said guitar to said backless mobile guitar shoulder strap, said user will slidable connect said pivot axle member to said U shaped mounting bracket, thereby attaching said guitar to said backless mobile guitar shoulder strap. When said user elects to slidable remove said pivot axle member from said U shaped mounting bracket, thereby detaching said guitar from said backless mobile guitar shoulder strap.

Wherein said user elects to attach said guitar to said belt, said user will slidable connect said pivot axle member to said U shaped mounting bracket, thereby attaching said guitar to said belt. When said user elects to slidable remove said pivot axle member from said U shaped mounting bracket, thereby detaching said guitar from belt.

In an alternative embodiment of the invention as shown in FIGS. 2-4 and 8, the guitar has a plate, said plate has a pivot axle member attached to it. The plate is then attaches to the back of said guitar using the existing neck attachment screws and bolts, and thereby connecting the plate to the guitar.

In the preferred embodiment of this invention, the pivot axle member has a nylon washer and nylon bushing/washer positioned on each side to create a slot for the U shaped mounting bracket to slidable connect to it.

In another alternative embodiment not shown, the flexible guitar system consists of a hardened steel Axle/bolt placed through a nylon washer and nylon bushing/washer that is then threaded into and fastened to a 2 inch wide by 5 inch long flat ⅛ inch aluminum plate, secured in place with a locknut from behind. The aluminum bracket is then fastened to the back of any guitar or bass instrument using the existing neck attachment bolts of the instrument, adding a spacer plate to keep the locknut off the guitar. If the neck is laminated and there are no existing neck attachment bolts the Axle/bolt with the washer and bushing/washer can be permanently affixed to the back of the guitar or bass during manufacturing.

For instruments where the neck is laminated to the body, the Axle/bolt can be attached to a custom aluminum bracket that is fitted across the back of the instrument, attaching it at each end to the existing guitar strap lugs. This works well on acoustic instruments also.

The Axle/bolt with the washer and bushing/washer, now being attached to the rear of the guitar, is then placed on a U Shaped Mounting Bracket that is made to swivel on top of a custom metal stand. The U Shaped Mounting Bracket also uses two nylon washers to swivel on, one at the top and one under the U Shaped Mounting Bracket. The stand is unique because it consists of a flat ⅛ inch piece of aluminum diamond floor plate the player stands on, for better stability while playing. It has an adjustable metal riser rod bolted through the floor plate, and a ½ inch thick rubber bushing fastened between the metal riser rod and the top of the floor plate for flexibility and dampening.

The weight of the guitar or bass is balanced on the Axle/bolt so the guitar sits at a perfect playing angle, with the washer and bushing/washer sitting on the U Shaped Mounting Bracket. The nylon washer and bushing/washer, together, act to eliminate the friction caused by any metal to metal contact between the Axle/bolt and the U Shaped Mounting Bracket.

By angling the U Shaped Mounting Bracket toward the player, using either a flexible or adjustable neck, or by bending the U Shaped Mounting Bracket at the top, the guitar or bass is tilted toward the player for a more natural playing position. The instrument can now be played as if it were floating in front of the artist and be totally supported by the stand. By mounting the U Shaped Mounting Bracket so it swivels, with some tension, the guitar stand supports the instrument and holds it in its natural playing position. The guitar has flexibility and freedom of movement with no weight to the artist, so it is a whole new playing experience, with many benefits.

By attaching the U Shaped Mounting Bracket, to a new holding device as discussed below: I have created a versatility guitar instrument beyond what is now the norm, which is a strap or a wall hanger. The guitar or bass can now, for the first time ever, be handled in a myriad of interesting ways.

1. Floor Stand:

By attaching the U Shaped Mounting Bracket to a floor stand the instrument now floats in front of the player always ready to play or display. Additionally, the floor stand can be design with a telescoping pole so it can be easily adjusted for the musician, whether the performer is standing or sitting.

2. Backless Mobile Guitar Shoulder Strap:

By attaching the U Shaped Mounting Bracket to a padded aluminum shoulder support the guitar can now be worn by the player and used to go mobile, as guitar straps facilitate. By using a miniature wireless device the artist can go wireless and experience the ultimate in mobility and swivel the instrument 360 degrees and back while still playing, thus opening the door for some unique guitar playing tricks.

3. Wall Mount:

By mounting the U Shaped Mounting Bracket to a wall on an aluminum bracket the instrument can now be placed on the wall as if floating in perfect playing position and be displayed as art.

4. Floating Belt Buckle:

By mounting the U Shaped Mounting Bracket to a customized belt buckle or waist belt the instrument can now be placed on the player's waist, taking the weight of the instrument off the back and placing it on the hips for less back pain.

5. Floating Hip Flex:

By mounting the U Shaped Mounting Bracket to a custom bracket that attaches to a belt and hangs down on the player's thigh, the instrument can now be worn in the cool way that some players prefer to wear them, down on their thigh. By making the bracket out of a strong reinforced rubber the instrument becomes more flexible to move and play.

6. Table Stand:

By mounting the U Shaped Mounting Bracket to a small table stand, instruments can be displayed for retail and promotional purposes at the point of sale, on the counter next to the cash register, for greater exposure.

7. GFlexX Floating Designer Clothing:

By attaching the U Shaped Mounting Bracket to clothing made for entertainment purposes. The guitar or bass can float directly on the clothing the player wears.

8. The GFlexX Floating Robot:

By attaching the U Shaped Mounting Bracket to a robotic device the instrument can now be delivered to the artist by a motorized floor device.

9. The GFlexX Custom Floating Display:

By attaching the U Shaped Mounting Bracket to any number of motorized designer displays, guitars or basses can become attractive and compelling displays for promotional purposes.

10. The GFlexX Instrument Cover:

By stitching a guitar or bass cover made out of fabric or plastic material and leaving it open at the bottom edge, and placing it on the instrument, the guitar can now be protected from dust and dirt and yet always be ready to play. By attaching two carrying straps, a zipper and some pockets to the cover, it can double as a gig bag, also transporting the GFlexX Mobile Express.

The Guitar or Bass can now be moved to any of these devices quickly and easily by lifting the guitar off one U Shaped Mounting Bracket and onto another. For the first time ever a guitar or bass player now has many choices in handling their instruments, without the need for a guitar strap.

Guitar and bass gaming controllers, which are made to be shaped like guitars and basses, can be adapted in the same way to make use of the versatility of the holding system.

It should also be kept in mind that various adjustments can be made depending on the desired use and needs of the user.

A multi-purpose holding device for use with guitar shaped instruments, said device comprising: a pivot axle member having attachment means for attaching said member to a guitar, a U-shaped mounting bracket member having first attachment means for attaching said member to a first substrate, said U-shaped mounting bracket member having second attachment means for attaching said member to a second substrate, said U-shaped mounting bracket member having third attachment means for attaching said member to a third substrate, said U-shaped mounting bracket member having fourth attachment means for attaching said member to a fourth substrate, said pivot axle member has a plate that attaches to the back of said guitar, said guitar with said pivot axle member has a slot for slidable connecting to said U-shaped mounting bracket members of said substrate's one through four, thereby allow a user to quickly and easily detach and reattach the holding substrate for said guitar, and wherein said substrates one through four are designed to support the entire weight of said guitar.

Wherein said guitar selected from a group consisting of classic guitar, flamenco guitar, plectrum guitar, acoustic guitar, 12-string guitar, hawaiian guitar, electric guitar, electric bass and guitar video game controller.

Wherein said first substrate is a guitar stand comprising: a base, an elongated shaft, said U-shaped mounting bracket for securing said guitar to said stand, said shaft has a first end that is mounted to said base and a second end that is attached to said mounting bracket, and wherein said U shaped mounting bracket has slidable connecting means for detaching and reattaching said guitar to said guitar stand.

Wherein in one embodiment of the invention, said elongated shaft has a height adjustable shaft. In al alternative embodiment not shown, said elongated shaft has a flexible gooseneck.

Wherein said second substrate is a backless mobile guitar shoulder strap comprising: a padded aluminum shoulder support, an adjustable front strap, said U shaped mounting bracket, said adjustable front strap has said U shaped mounting bracket attached to said strap, and wherein said U shaped mounting bracket has slidable connecting means for detaching and reattaching said guitar to said mobile guitar shoulder strap.

Wherein said third substrate is a belt having a means for attaching said U shaped mounting bracket to said belt, said belt has connecting mean for attaching said belt to said user and wherein said U shaped mounting bracket has slidable connecting means for detaching and reattaching said guitar to said belt.

Wherein said fourth substrate is a wall mount having means for attached to a wall and said U shaped mounting bracket, wherein said U shaped mounting bracket has slidable connecting means for detaching and reattaching said guitar to said wall mount.

A method of using a multi-purpose holding device for use with guitar shaped instruments comprising the steps of: providing a guitar having a pivot axle member having attachment means for attaching said member to said guitar, a guitar stand having a U-shaped mounting bracket member having first attachment means for attaching said member to said guitar stand, a backless mobile guitar shoulder strap having said U-shaped mounting bracket member having second attachment means for attaching said member to said strap, a belt having said U-shaped mounting bracket member having third attachment means for attaching said member to said strap, said guitar with said pivot axle member has a slot for slidable connecting to said U-shaped mounting bracket members, and thereby allow a user to quickly and easily detach and reattach said guitar from said U shaped mounting brackets, and wherein said user elects to attach said guitar to said guitar stand, said user will slidable connect said pivot axle member to said U shaped mounting bracket, thereby attaching said guitar to said guitar stand, wherein said user elects to slidable remove said pivot axle member from said U shaped mounting bracket, thereby detaching said guitar from said guitar stand, wherein said user elects to attach said guitar to said backless mobile guitar shoulder strap, said user will slidable connect said pivot axle member to said U shaped mounting bracket, thereby attaching said guitar to said backless mobile guitar shoulder strap, wherein said user elects to slidable remove said pivot axle member from said U shaped mounting bracket, thereby detaching said guitar from said backless mobile guitar shoulder strap, wherein said user elects to attach said guitar to said belt, said user will slidable connect said pivot axle member to said U shaped mounting bracket, thereby attaching said guitar to said belt, wherein said user elects to slidable remove said pivot axle member from said U shaped mounting bracket, thereby detaching said guitar from belt, and wherein said user elects when to attach and remove said guitar from said U shaped mounting brackets and the holding mounts.

Wherein said guitar selected from a group consisting of classic guitar, flamenco guitar, plectrum guitar, acoustic guitar, 12-string guitar, hawaiian guitar, electric guitar, electric bass and guitar video game controller.

Wherein said pivot axle member has a plate that attaches to the back of said guitar and screws for connecting said plate to said guitar.

Wherein said guitar stand comprising: a base, an elongated shaft, said U-shaped mounting bracket for securing said guitar to said stand, said shaft has a first end that is mounted to said base and a second end that is attached to said mounting bracket, and wherein said U shaped mounting bracket has slidable connecting means for detaching and reattaching said guitar to said guitar stand.

Wherein said guitar stand has an adjustable and flexible extending shaft that allows the user to move around while operating the guitar on the stand.

Wherein said backless mobile guitar shoulder strap comprises: a padded aluminum shoulder support, an adjustable front strap, said U shaped mounting bracket, said adjustable front strap has said U shaped mounting bracket attached to said strap, and wherein said U shaped mounting bracket has slidable connecting means for detaching and reattaching said guitar to said mobile guitar shoulder strap.

Wherein said backless mobile guitar shoulder strap has an adjustable strap and said U shaped mounting bracket which it is attached to, wherein said U shaped mounting bracket has slidable connecting means for connecting said guitar to said strap, thereby allowing said user to be mobile or move around while operating the guitar.

Wherein said belt having a means for attaching said U shaped mounting bracket to said belt, said belt has connecting mean for attaching said belt to said user and wherein said U shaped mounting bracket has slidable connecting means for detaching and reattaching said guitar to said belt.

In the preferred embodiment of this invention, a shoulder strap comprises: a backless shoulder strap; said shoulder strap has an adjustable front strap; an U shaped mounting bracket, which is attached to said shoulder strap; said U shaped mounting bracket has slidable connecting means for connecting an instrument to said shoulder strap; and wherein said instrument has a pivot axle member having attachment means for attaching said member to said instrument, thereby allowing a user the ability to connect said pivot axle member to said U shaped mounting bracket for attaching and detaching said instrument to said shoulder strap.

While the description above refers to particular embodiments of the present invention, it will be understood that modifications may be made without departing from the spirit thereof. The presently disclosed embodiments are therefore to be considered in all respects as illustrative and not restrictive.

What is claimed is:

1. An instrument shoulder strap comprising:

a backless shoulder strap, said strap engaging only one shoulder of a user and not extending across said user's back and supporting an instrument about the middle of said user's body;

said shoulder strap has an adjustable length front strap;

a U shaped mounting bracket, which is attached to said front strap near the middle of said user's body; and wherein said U shaped mounting bracket has slidable connecting means for connecting said instrument having a strap button to said shoulder strap.

2. The device of claim 1, wherein said instrument strap button has a pivot axle member that has a plate that attaches to said instrument and screws for connecting said plate to said instrument, thereby allowing a user the ability to connect said pivot axle member to said U shaped mounting bracket for attaching and detaching said instrument to said shoulder strap.

3. The device of claim 1, wherein said instrument strap button has a pivot axle member having attachment means for attaching said member to said instrument, thereby allowing a user the ability to connect said pivot axle member to said U shaped mounting bracket for attaching and detaching said instrument to said shoulder strap.

4. The device of claim 1, wherein said instrument strap button has a pivot axle member for connecting to said U shaped mounting bracket for attaching and detaching said instrument to said shoulder strap.

5. The device of claim 1, wherein said shoulder strap further comprises a padded aluminum shoulder support.

6. The device of claim 4, wherein said instrument is a musical instrument and said shoulder strap is a musical instrument shoulder strap.

7. The device of claim 4, wherein said instrument is a guitar and said shoulder strap is a guitar shoulder strap.

8. The device of claim 7, wherein said guitar selected from a group consisting of classic guitar, flamenco guitar, plectrum guitar, acoustic guitar, 12-string guitar, hawaiian guitar, electric guitar, electric bass and guitar video game controller.

9. A guitar shoulder strap comprising:

a backless shoulder strap, said strap engaging only one shoulder of a user and not extending across said user's back and supporting a guitar about the middle of said user's body;

said shoulder strap has an adjustable length front strap;

a U shaped mounting bracket, which is attached to said front strap near the middle of said user's body; and wherein said U shaped mounting bracket has slidable connecting means for connecting said guitar having a strap button to said shoulder strap.

10. The device of claim 9, wherein said shoulder strap further comprises a padded aluminum shoulder support.

11. The device of claim 9, wherein said guitar strap button has a pivot axle member that has a plate that attaches to said guitar and screws for connecting said plate to said guitar, thereby allowing said user the ability to connect said pivot axle member to said U shaped mounting bracket for attaching and detaching said guitar to said shoulder strap.

12. The device of claim 9, wherein said guitar strap button has a pivot axle member having attachment means for attaching said member to said guitar, thereby allowing said user the ability to connect said pivot axle member to said U shaped mounting bracket for attaching and detaching said guitar to said shoulder strap.

13. The device of claim 9, wherein said guitar strap button has a pivot axle member for connecting to said U33 shaped mounting bracket for attaching and detaching said guitar to said shoulder strap.

14. The device of claim 9, wherein said guitar selected from a group consisting of classic guitar, flamenco guitar, plectrum guitar, acoustic guitar, 12-string guitar, hawaiian guitar, electric guitar, electric bass and guitar video game controller.

15. A method of using a guitar shoulder strap comprising the steps of:

providing a guitar having a pivot axle member having attachment means for attaching said member to said guitar, a backless shoulder strap, said strap engaging only one shoulder of a user and not extending across said user's back and supporting a guitar about the middle of said user's body, said shoulder strap has an adjustable length front strap, a U shaped mounting bracket, which is attached to said front strap near the middle of said user's body;

wherein said user elects to attach said guitar having a strap button to said front strap, said user will slidable connect said pivot axle member to said U shaped mounting bracket, thereby attaching said guitar to said shoulder strap, and wherein said user elects to detaching said guitar having a strap button from said front strap, said user will slidable remove said pivot axle member from said U shaped mounting bracket, thereby detaching said guitar from said shoulder strap.

16. The method of claim 15, wherein said shoulder strap further comprises a padded aluminum shoulder support.

17. The method of claim 15, wherein said guitar selected from a group consisting of classic guitar, flamenco guitar, plectrum guitar, acoustic guitar, 12-string guitar, hawaiian guitar, electric guitar, electric bass and guitar video game controller.

18. The method of claim 15, wherein said guitar strap button having said pivot axle member has a plate that attaches to said guitar and screws for connecting said plate to said guitar, thereby allowing a user the ability to connect said pivot axle member to said U shaped mounting bracket for attaching and detaching said guitar to said shoulder strap.

19. The method of claim 15, wherein said guitar strap button has a pivot axle member for connecting to said U shaped mounting bracket for attaching and detaching said guitar to said shoulder strap.

* * * * *